US006176755B1

(12) United States Patent
Bye et al.

(10) Patent No.: US 6,176,755 B1
(45) Date of Patent: Jan. 23, 2001

(54) TOY VEHICLES FROM PLASTIC BOTTLES

(75) Inventors: Karen A. Bye, Grand Forks; Lisa M. Nagle, Manvel; Mark S. Neary; Jennifer M. Oliva, both of Grand Forks, all of ND (US)

(73) Assignee: Dakota Science Center, Grand Forks, ND (US)

( * ) Notice: Under 35 U.S.C. 154(b), the term of this patent shall be extended for 0 days.

(21) Appl. No.: 09/298,343

(22) Filed: Apr. 23, 1999

(51) Int. Cl.[7] ..... A63H 17/267

(52) U.S. Cl. ..... 446/78; 446/95; 446/465; 446/77

(58) Field of Search ..... 446/71, 74, 77, 446/78, 88, 93, 94, 95, 96, 431, 465, 469, 470

(56) References Cited

U.S. PATENT DOCUMENTS 1,586,608 * 6/1926 Carver ..... 446/431
3,777,392 * 12/1973 Span et al. ..... 446/78
3,830,010 * 8/1974 Dowrick ..... 446/77
3,883,983 * 5/1975 Coster ..... 446/78
4,295,293 * 10/1981 Baclit ..... 446/78
4,631,040 * 12/1986 Shiraishi ..... 446/95
5,154,657 * 10/1992 Wildman et al. ..... 446/78

* cited by examiner

*Primary Examiner*—Jacob K. Ackun
*Assistant Examiner*—Jeffrey D. Carlson
(74) *Attorney, Agent, or Firm*—Arnold White & Durkee

(57) ABSTRACT

The present disclosure involves a toy vehicle and method of construction therefor involving the use of plastic bottles. Toy vehicles constructed according to the present invention are advantageous in that they educate children as to the importance of recycling at the same time they are being entertained by constructing and/or playing with the toy vehicles. Toy vehicles according to the present invention are constructed by coupling any of a plurality of simulated vehicular elements to a plastic bottle to produce any of a variety of simulated vehicles, including but not limited automobiles, motorcycles, sailboats, space ships, trains, etc.

12 Claims, 9 Drawing Sheets

TOY VEHICLES FROM PLASTIC BOTTLES

BACKGROUND OF THE INVENTION

I. Field of the Invention

This invention relates generally to toys and, more particularly, to toy vehicles and a method of constructing toy vehicles which involves the use of plastic bottles.

II. Discussion of the Prior Art

Environmental consciousness has enjoyed increased growth in recent years due, in large part, to the ever-increasing environmental problems associated with pollution, global warming, etc. One avenue for minimizing or avoiding these environmental ills involves instilling in our youth a keen awareness of the importance of protecting the environment for future generations. In this fashion, our children will hopefully be cognizant of environmental issues throughout their lifetime and, hence, more vigilant in protecting the environment than generations past. A problem exists, however, in that it isn't always easy to obtain and maintain the interest of children in scientific topics such as environmental awareness. Oftentimes, children would rather be playing with toys or endeavoring in other play activities.

What is needed, therefore, is a mechanism to educate children regarding environmental awareness while maintaining their interest, such as by playing with or making a toy. Such a mechanism would be particularly advantageous within a focused academic curriculum aimed at fostering environmental awareness. The present invention is directed at such a mechanism.

SUMMARY OF THE INVENTION

In accordance with a broad aspect of the present invention, a toy vehicle is provided having a main body comprising a plastic bottle, and a plurality of simulated vehicular elements coupled to the main body.

In a further broad aspect of the present invention, a method is provided for manufacturing a toy vehicle, comprising the steps of: (a) providing a main body comprising a plastic bottle; and (b) coupling a plurality of simulated vehicular elements to the main body.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention involves the use of plastic bottles in the construction of toy vehicles. More specifically, as will be described in greater detail below, the present invention involves a toy vehicle formed by attaching any number of different simulated vehicular elements to a plastic bottle so as to create any number of simulated vehicles, including but not limited to automobiles, trains, airplanes, space ships, rockets, sail boats, motorcycles, etc . . . Employing plastic bottles in this fashion is advantageous in that it promotes environmental awareness (i.e. recycling) while providing entertainment to the children who construct and/or play with such toy vehicles. This is an important feature in that it serves to instill in our youth an eco-friendly mindset such that they comprehend and appreciate the importance of protecting the environment. Because of this, the task of constructing toy vehicles in accordance with the present invention is particularly suited to be incorporated into a deliberately focused academic curriculum promoting environmental awareness.

Figure 1:
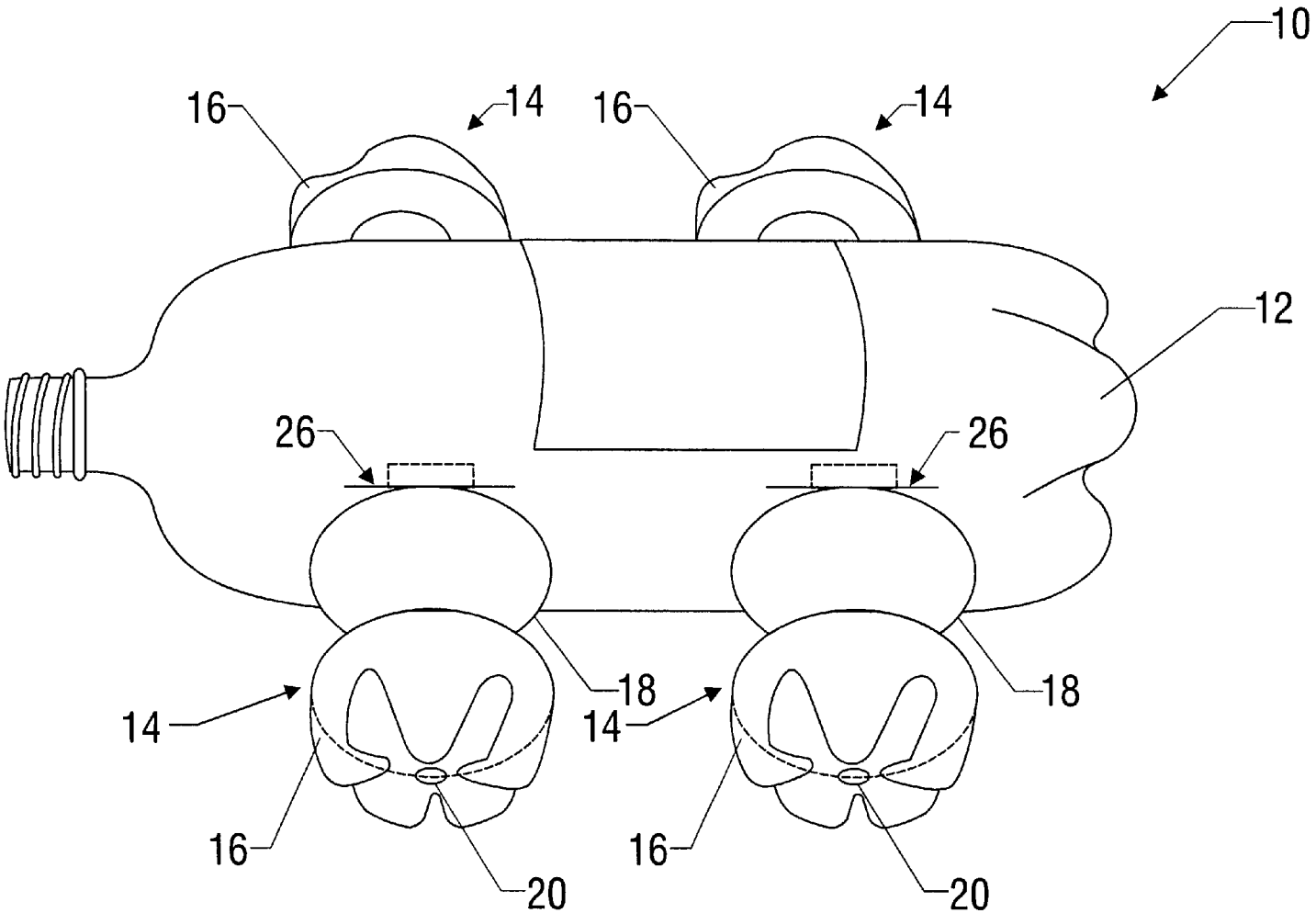
FIG. 1 is a perspective view illustrating a toy vehicle in accordance with one exemplary embodiment of the present invention comprising a simulated automobile.
Figure 6:
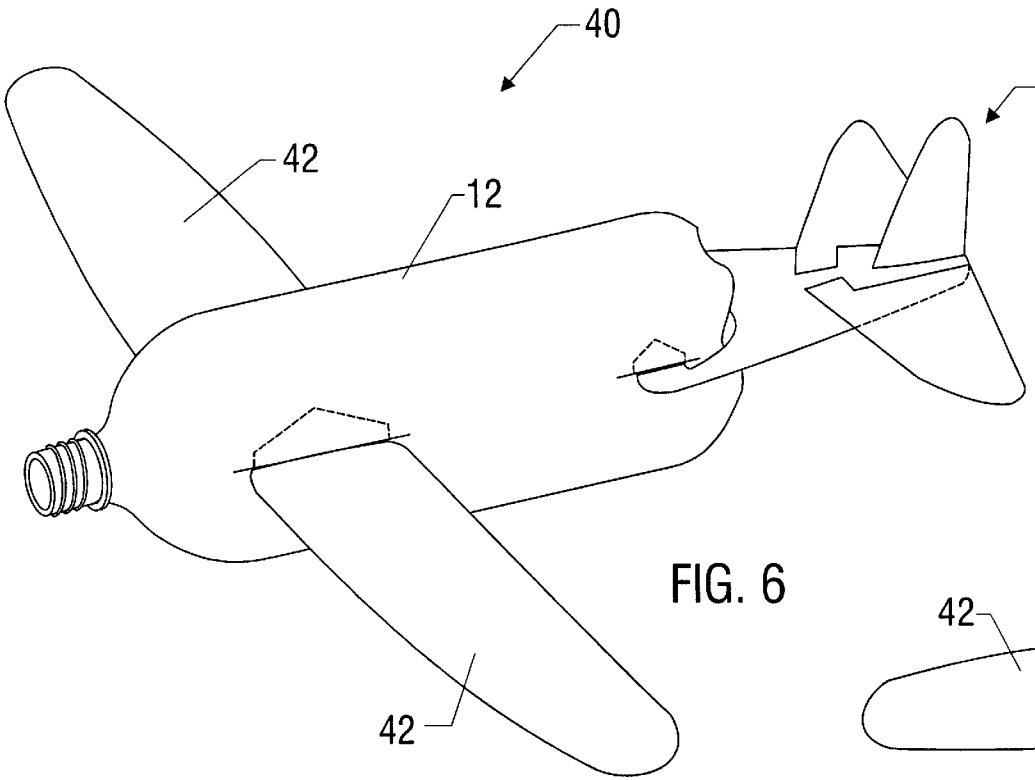
FIG. 6 is a perspective view illustrating a toy vehicle in accordance with a still further exemplary embodiment of the present invention comprising a simulated airplane.
Figure 7:
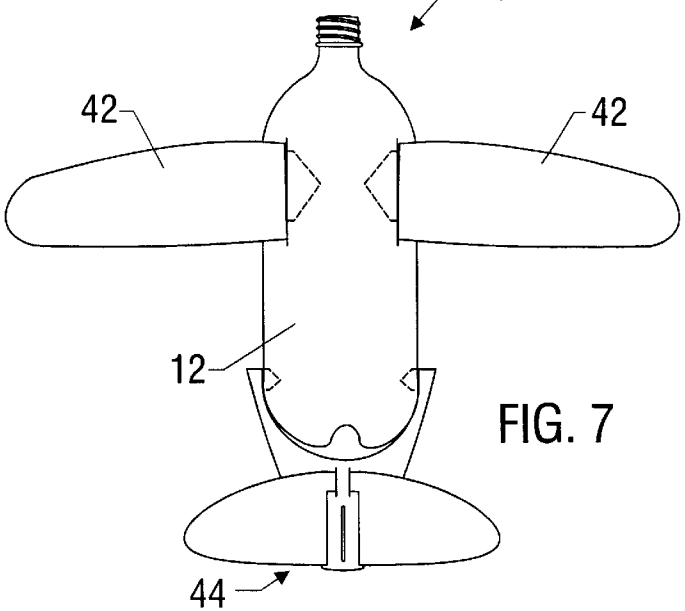
FIG. 7 is a top plan view of the toy vehicle shown in FIG. 6.

Referring initially to FIG. 1, shown is a toy vehicle 10 provided in accordance with an exemplary embodiment of the present invention. The toy vehicle 10 of this embodiment is intended to simulate an automobile having four wheels. Although shown by way of example as an automobile in FIG. 1, it is to be readily understood that the toy vehicle and method of construction therefor according to the present invention may form any number of different types of vehicles depending upon the types of simulated vehicular elements which are attached to the main plastic bottle. As used herein, the term "simulated vehicular element" means any component or combination of components that, when coupled to a plastic bottle, serves to transform the plastic bottle into a simulated vehicle. For example, as will be explained in greater detail below, the simulated vehicular elements may comprise wings and/or fins to produce the simulated air plane shown in FIGS. 6–7, wheel assemblies to produce the three-wheeled motorcycle shown in FIGS. 8–9, a sail assembly and/or keel to produce the simulated sail boat shown in FIG. 10, wheel assemblies and structure to produce the simulated train shown in FIGS. 11–12, or fins to produce the simulated space ship shown in FIG. 13.

Figure 2:
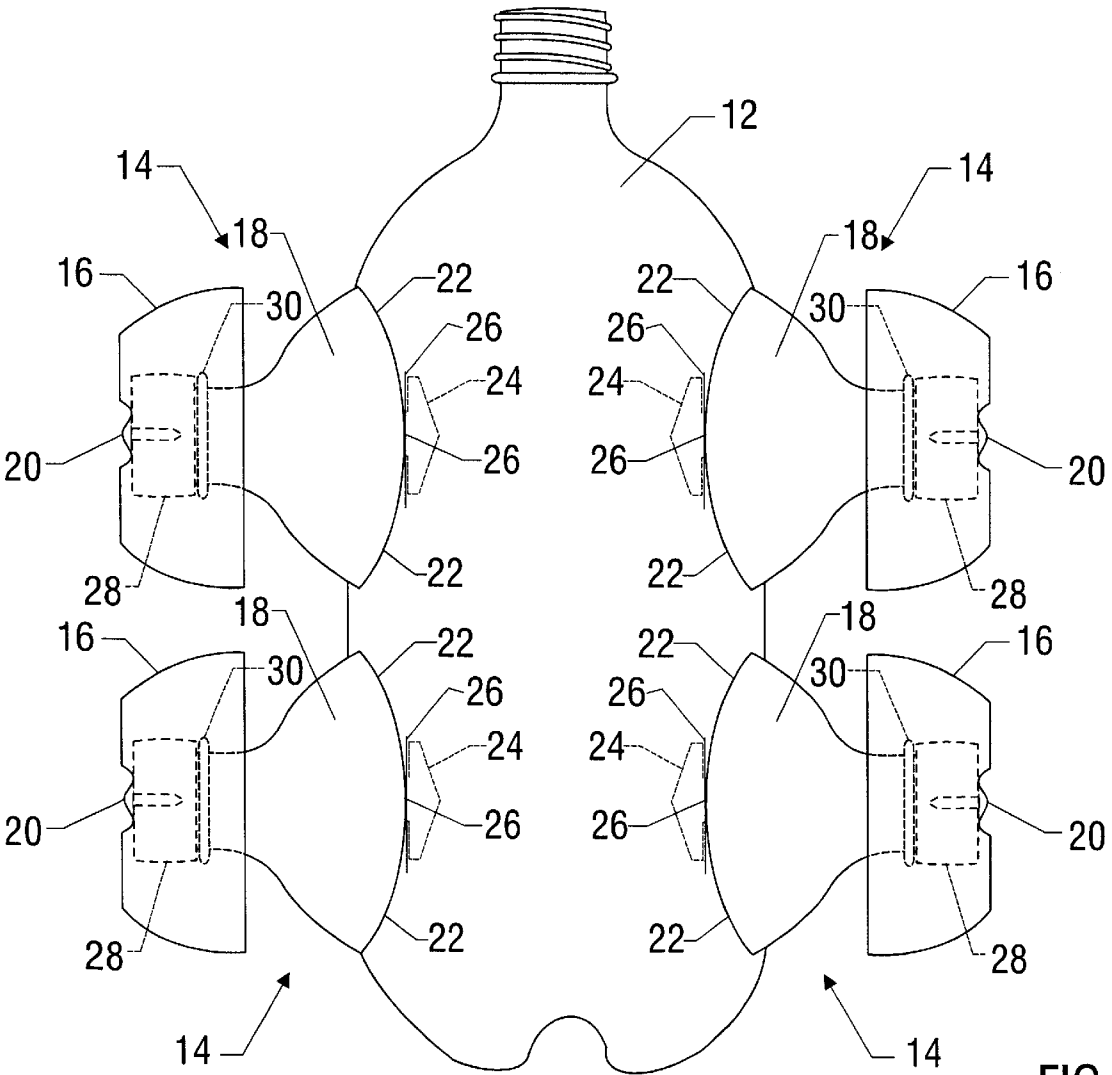
FIG. 2 is a top plan view of the toy vehicle shown in FIG. 1.

Referring once again to FIG. 1, the toy vehicle 10 includes a main body 12 and a plurality of wheel assemblies 14 coupled to the main body 12 to form an automobile capable of being rolled around on the ground. In the embodiment shown, the main body 12 comprises a 2 liter plastic bottle and each wheel assembly 14 comprises a plastic bottle bottom portion 16 rotatably coupled to a plastic bottle top portion 18 via a screw 20. As shown in FIG. 2, each plastic bottle top portion 18 includes curvuate engagement portions 22 which mate generally flushly against the main body 12. By way of example only, each plastic bottle top portion 18 is coupled to the main body 12 via a pair of engagement tabs 24 which are received within corresponding engagement slots 26 formed in the main body 12.

In the embodiment shown, each pair of engagement tabs 24 on a given plastic bottle top portion 18 are located in vertically aligned relation (one directly above the other), as are each pair of engagement slots 26 on the main body 12. Those skilled in the art will appreciate that any number of different coupling arrangements can be used to secure the wheel assemblies 14 to the main body 12 without departing from the scope of the present invention. For example, the engagements tabs 24 and engagement slots 26 can be arranged in any number of different fashions, such as in horizontally aligned relation (one directly aside the other). The number of engagement tabs 24 and engagement slots 26 can also be varied without departing from the scope of the invention. Those skilled in the art will also recognize that various other coupling arrangements may be employed, including but not limited to adhesives, Velcro®, or other suitable attachment means.

In the embodiment shown, each plastic bottle bottom portion 16 is rotatably coupled to a corresponding plastic bottle top portion 18 through the use of a screw 20. More specifically, a hole (not shown) is preferably created proximate the central axis of the plastic bottle bottom portion 16. The screw 20 can then be passed through the hole (not shown) and screwed into a bottle cap 28 disposed on a threaded spout portion 30 of the plastic bottle top portion 18. The hole (not shown) should be sufficiently larger in diameter than the screw 20, and sufficient space provided between the bottle cap 28 and the interior surface of the plastic bottle bottom portion 16, such that the plastic bottle bottom portion 16 can rotate with ease about the screw 20. It will be appreciated by those skilled in the art that the foregoing coupling mechanism is provided by way of example and not limitation. That is to say, any number of arrangements can be used to rotatably couple the plastic bottle bottom portion 16 to the plastic bottle top portion 18 without departing from the scope of the present invention. For example, bolts could be employed with accompanying washers and/or nuts, as could rivets.

The plastic bottles employed in manufacturing the toy vehicle 10 of the present invention are well known in the art for their use in bottling soda and other beverages for general consumption. In an important aspect of the present invention, the plastic bottles used to construct the toy vehicle 10 should preferably be recycled. In this fashion, the children who endeavor to build and play with the toy vehicle 10 of the present invention will be made aware of the environmental benefit of recycling at the same time they are entertained. Due to this, educators may wish to include in their curriculum activities involving the construction of toy vehicles according to the present invention.

Figure 4:
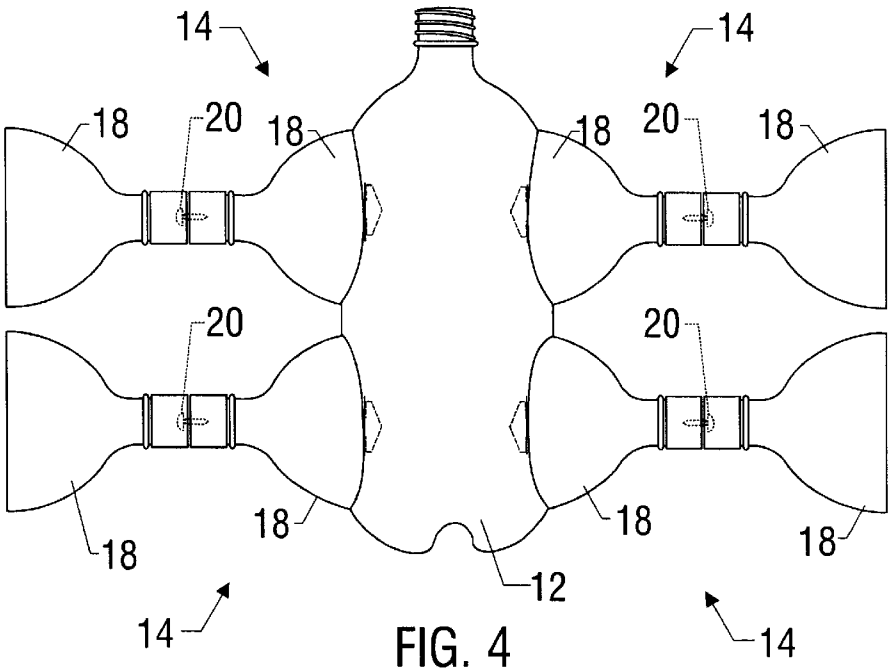
FIGS. 3–5 are top plan views of a toy vehicle comprising a simulated automobile according to still further exemplary embodiments of the present invention.
Figure 3:
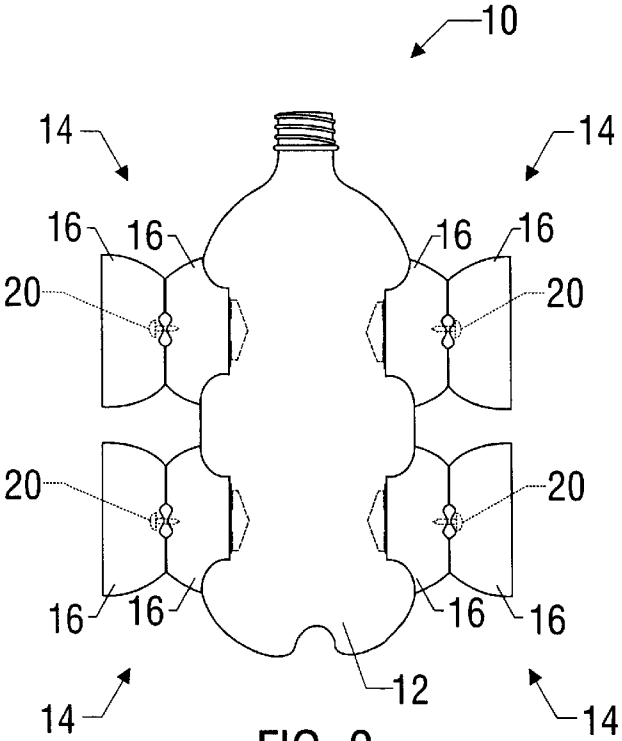
Figure 5:
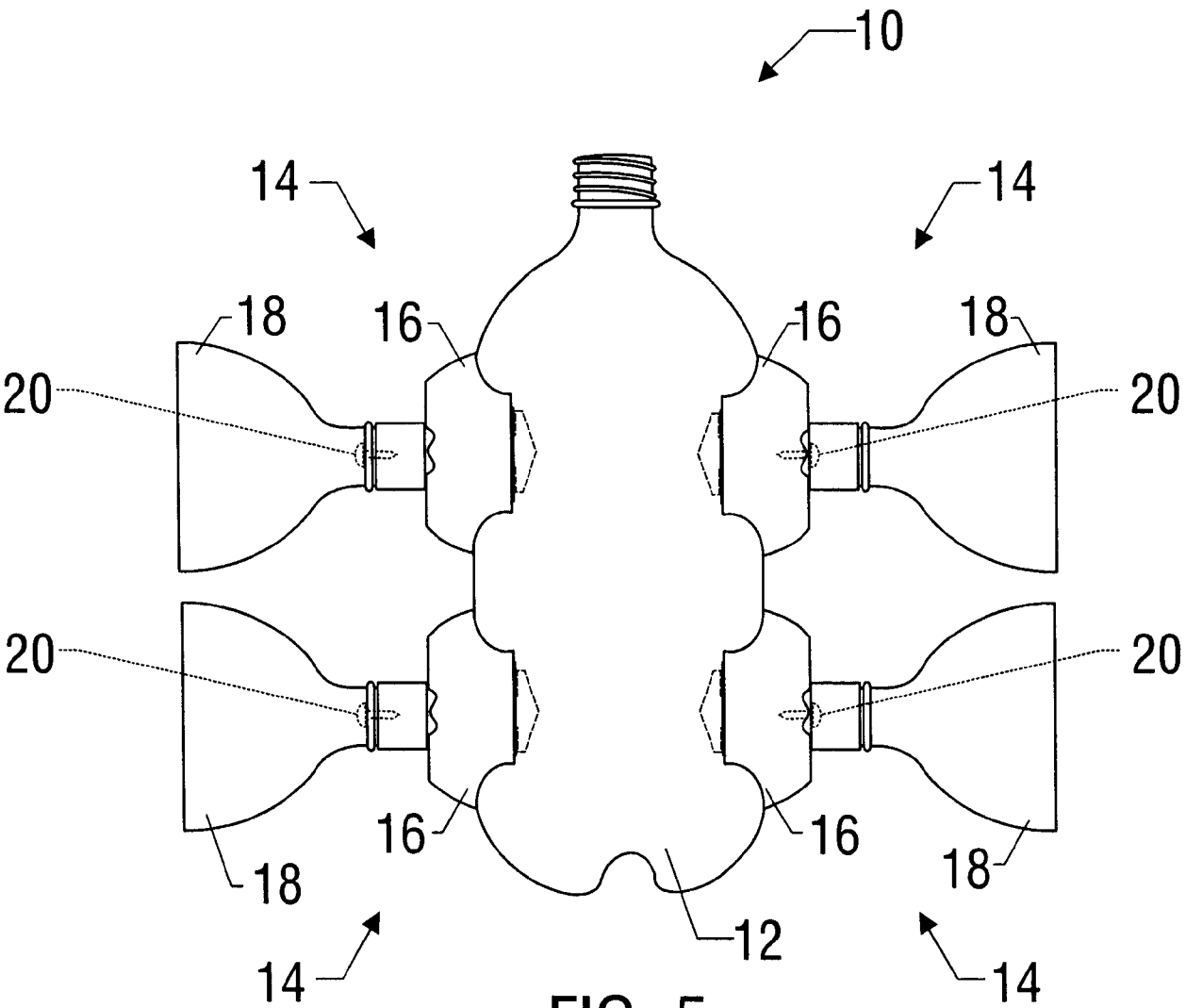

It should be appreciated that the foregoing embodiment is provided by way of example only and that any number of different configurations can be employed to construct a toy vehicle 10 in accordance with the present invention. For example, with reference to FIGS. 3–5, the wheel assemblies 14 can be constructed from two plastic bottle bottom portions 16 rotatably coupled together (FIG. 3), two plastic bottle top portions 18 rotatably coupled together (FIG. 4), or a plastic bottle top portion 18 rotatably coupled to a plastic bottle bottom portion 16 (FIG. 5). It should be further appreciated that the toy vehicle 10 of the present invention can also take the form of any of a variety of different vehicle types, such as by employing plastic bottles of varying sizes and shapes. The number of wheel assemblies 14 can also be increased or decreased without departing from the scope of the present invention.

The toy vehicle of the present invention may also take a number of different forms other than the simulated automobile shown in FIGS. 1–5. For example, within the scope of the present invention are embodiments including the toy vehicle 40 shown in FIGS. 6–7 comprising a simulated an airplane, the toy vehicle 50 shown in FIGS. 8–9 comprising a simulated three-wheeled motorcycle, the toy vehicle 60 shown in FIG. 10 comprising a simulated sail boat, the toy vehicle 70 shown in FIGS. 11–12 comprising a simulated train, or the toy vehicle 80 shown in FIG. 13 comprising a simulated space ship.

Figure 8:
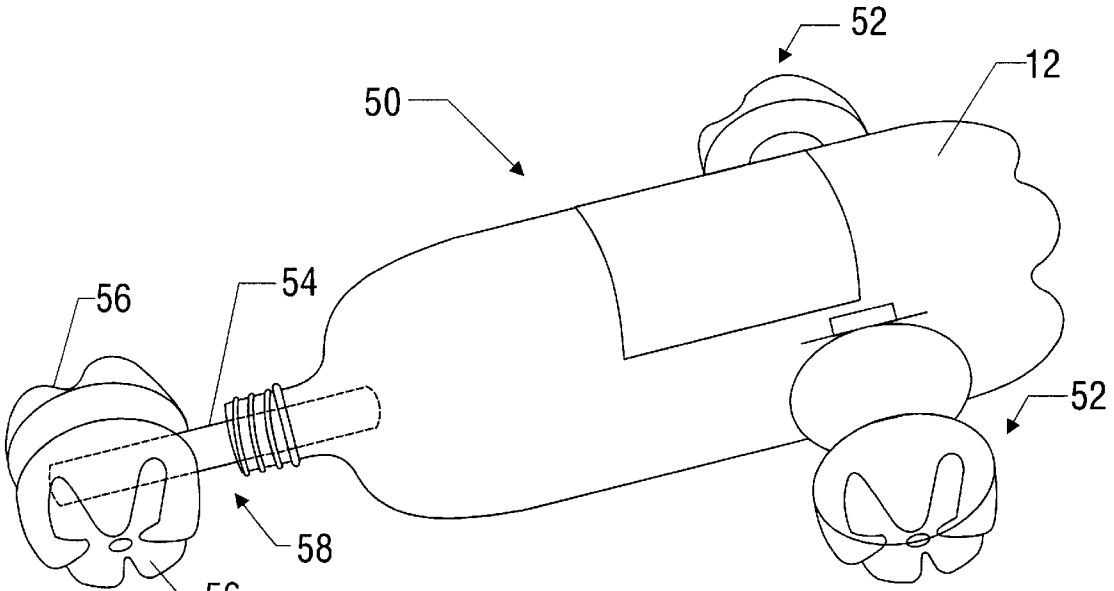
FIG. 8 is a perspective view illustrating a toy vehicle in accordance with another exemplary embodiment of the present invention comprising a simulated three-wheeled motorcycle.
Figure 9:
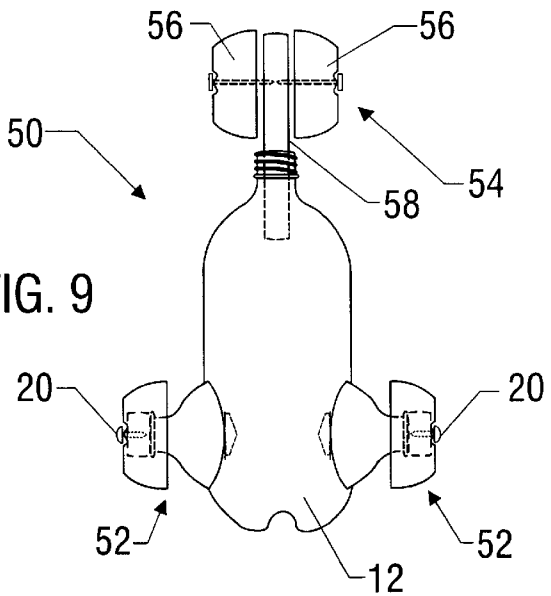
FIG. 9 is a top plan view of the toy vehicle shown in FIG. 8.

For the embodiments shown in FIGS. 6–13, the simulated vehicular elements may comprise any suitable components that assist in transforming the plastic bottle into the desired type of vehicle. For example, with reference to FIGS. 6–7, the toy vehicle 40 may be equipped with wings 42 and a tail fin assembly 44 comprised of plastic, wood, or any other suitable material or combination of materials. With reference to FIGS. 8–9, the toy vehicle 50 may be equipped with side wheel assemblies 52 (of the type described above with reference to FIGS. 1–5) and a front wheel assembly 54 comprising a pair of plastic bottle bottom portions 56 rotatably disposed on a dowel 58 extending from the opening of the plastic bottle 12.

Figure 10:
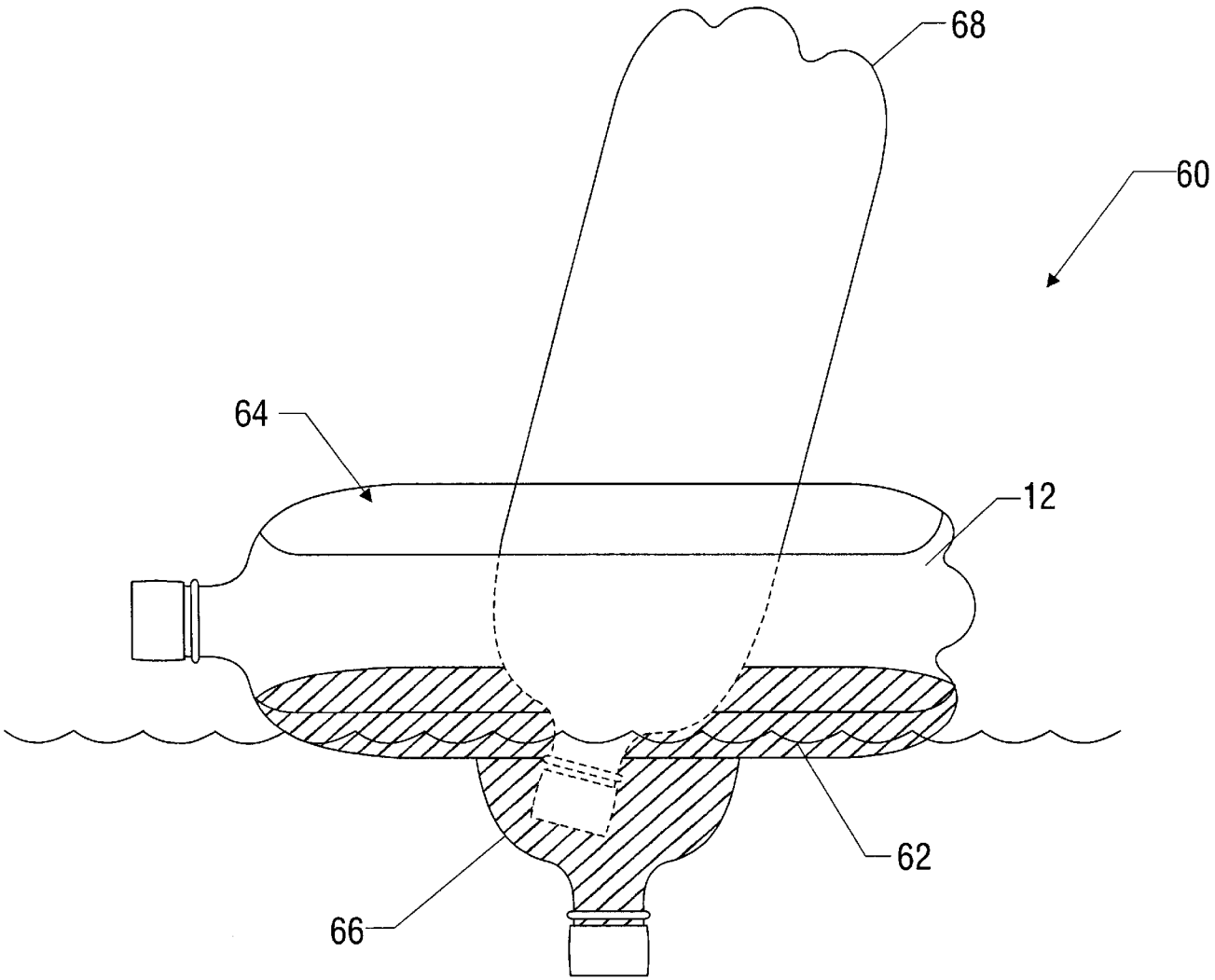
FIG. 10 is a perspective view illustrating a toy vehicle in accordance with a further exemplary embodiment of the present invention comprising a simulated sailboat.

With reference to FIG. 10, the toy vehicle 60 may be equipped with a keel assembly 66 (comprising a plastic bottle top portion coupled to the plastic bottle 12) having sand 62 disposed therein for ballast. A sail assembly 68 is coupled to the plastic bottle 12. In this embodiment, the sail assembly 68 comprises one-half of a plastic bottle with one end disposed within the sand 62. In this fashion, the inner concave surface of the one-half plastic bottle comprising the sail assembly 68 is positioned to serve as a sail for propelling the toy vehicle 60 in the water. has a concave surface (which is within an aperture 64 formed within the plastic bottle 12

Figure 11:
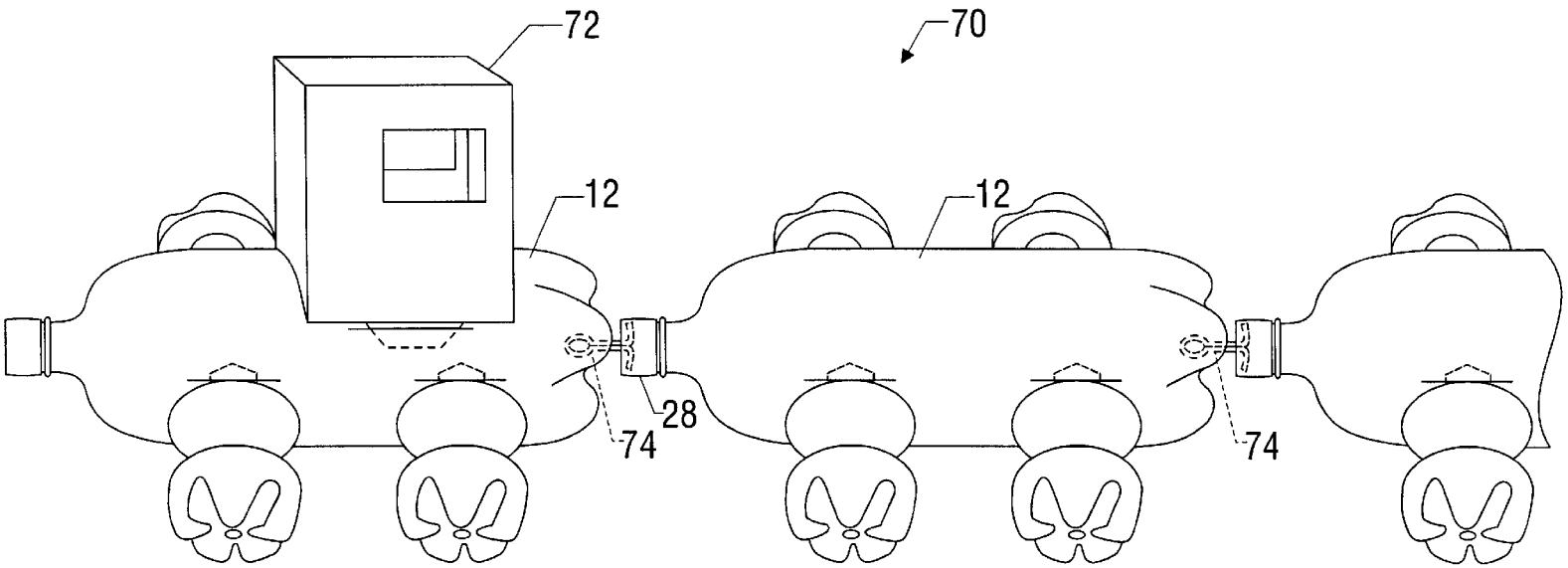
FIG. 11 is a perspective view illustrating a toy vehicle in accordance with another exemplary embodiment of the present invention comprising a simulated train.
Figure 12:
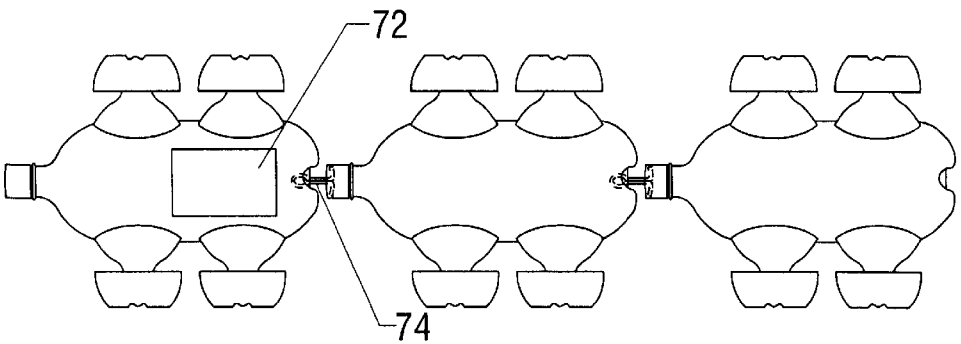
FIG. 12 is a top plan view of the toy vehicle shown in FIG. 11.

With reference to FIGS. 11–12, the toy vehicle 70 may be equipped with any number of types of structure, such as a cardboard box 72, in order to simulate the appearance of a train. Other than the addition of structures such as the cardboard box 72, the construction of the individual units of the overall train can be identical to that employed to construct the simulated automobiles shown and described above with reference to FIGS. 1–5. Any number of mechanisms may be used to couple the individual units together to form the overall train. By way of example only, one such coupling mechanism may be a cotter pin 74 extending from the end of one plastic bottle 12 into the bottle cap 28 of the following plastic bottle 12.

Figure 13:
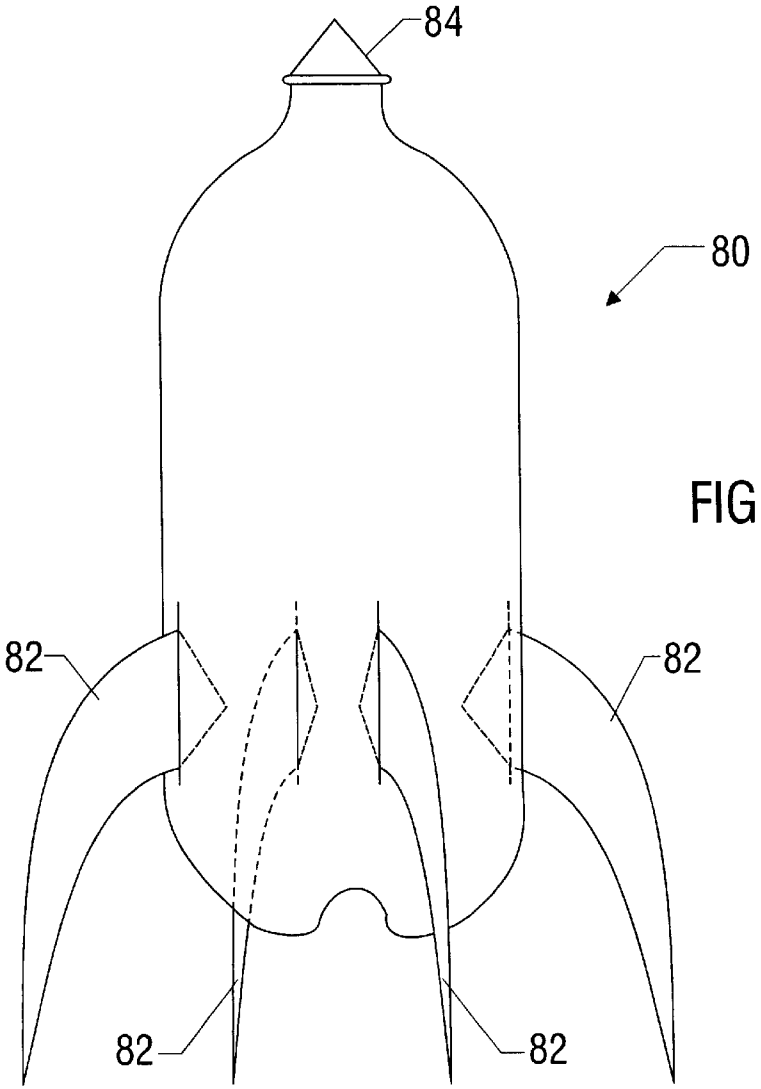
FIG. 13 is a perspective view illustrating a toy vehicle in accordance with a further exemplary embodiment of the present invention comprising a simulated space ship.

Lastly, with reference to FIG. 13, the toy vehicle 80 may be constructed to include fins 82 to produce the appearance of a simulated space ship. Once again, the fins 82 may be constructed out of any suitable material, including but not limited to plastic, wood, or any other material. If desired, the plastic bottle 12 may be further equipped with a nose cone 84 disposed in the spout portion to further approximate a space ship.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined by the appended claims.

What is claimed is:

1. A toy vehicle comprising:

(a) a main body comprising a plastic bottle; and (b) a plurality of wheel assemblies coupled to said main body;

each of said wheel assemblies including a first plastic bottle portion coupled to said main body and a second plastic bottle portion rotatably coupled to said first plastic bottle portion.

2. The toy vehicle set forth in claim 1 and further, each said first plastic bottle portion comprising a plastic bottle top portion including a threaded spout portion and a bottle cap threadably secured to said threaded spout portion.

3. The toy vehicle set forth in claim 2 and further, each said second plastic bottle portion comprising a plastic bottle bottom portion rotatably coupled to said bottle cap of said plastic bottle top portion.

4. The toy vehicle set forth in claim 3 and further, each of said plurality of wheel assemblies including a coupling member for rotatably coupling said plastic bottle bottom portion to said bottle cap of said plastic bottle top portion.

5. The toy vehicle set forth in claim 4 and further, wherein said coupling member of each of said plurality of wheel assemblies comprises a screw.

6. The toy vehicle set forth in claim 1 and further, wherein said first plastic bottle portion of each of said plurality of plastic bottle wheel assemblies comprises a plastic bottle top portion, and wherein said second plastic bottle portion of each of said plurality of plastic bottle wheel assemblies comprises a plastic bottle bottom portion.

7. The toy vehicle set forth in claim 1 and further, wherein said first plastic bottle portion of each of said plurality of plastic bottle wheel assemblies comprises a plastic bottle bottom portion, and wherein said second plastic bottle portion of each of said plurality of plastic bottle wheel assemblies comprises a plastic bottle top portion.

8. The toy vehicle set forth in claim 1 and further, wherein said first plastic bottle portion and said second plastic bottle portion of each of said plurality of plastic bottle wheel assemblies each comprise a plastic bottle bottom portion.

9. The toy vehicle set forth in claim 1 and further, wherein said first plastic bottle portion and said second plastic bottle portion of each of said plurality of plastic bottle wheel assemblies each comprise a plastic bottle top portion.

10. A method of manufacturing a toy vehicle, comprising the steps of:

(a) providing a main body comprising a plastic bottle; and (b) coupling a plurality of wheel assemblies to said main body, wherein step (b) comprises the sub-step of providing each of said wheel assemblies as including a first plastic bottle portion rotatably coupled to a second plastic bottle portion, and the further sub-step of coupling said first plastic bottle portion to said main body.

11. The method as set forth in claim 10, wherein step (a) comprises the further sub-step of forming a plurality of engagement slots in said main body, and step (b) comprises the further sub-step of providing each said first plastic bottle portion with engagement tabs for engaging within said engagement slots to couple said first plastic bottle portion to said main body.

12. The method as set forth in claim 11, wherein step (b) comprises the further sub-step of providing each said first plastic bottle portion as a plastic bottle top portion with a threaded spout portion and a bottle cap threadably secured to said threaded spout portion, and the further substep of rotatably coupling said second plastic bottle portion to said bottle cap of said plastic bottle top portion.

* * * * *